US005779461A

United States Patent [19]

Iizuka et al.

[11] Patent Number: 5,779,461

[45] Date of Patent: Jul. 14, 1998

[54] SCROLL TYPE FLUID DISPLACEMENT APPARATUS HAVING A CONTROL SYSTEM OF LINE CONTACTS BETWEEN SPIRAL ELEMENTS

[75] Inventors: Jiro Iizuka, Takasaki; Kiyoshi Miyazawa, Annaka, both of Japan

[73] Assignee: Sanden Company, Gunma, Japan

[21] Appl. No.: 719,418

[22] Filed: Sep. 24, 1996

Related U.S. Application Data

[62] Division of Ser. No. 530,890, Sep. 20, 1995, abandoned.

[30] Foreign Application Priority Data

Sep. 20, 1994 [JP] Japan ..... 6-253054

[51] Int. Cl.[6] ..... F01C 1/04

[52] U.S. Cl. ..... 418/55.5; 418/57

[58] Field of Search ..... 418/55.5, 57

[56] References Cited

U.S. PATENT DOCUMENTS

| | | | |
|---|---|---|---|
| 5,174,739 | 12/1992 | Kim | 418/55.5 |
| 5,201,645 | 4/1993 | Steele | 418/55.5 |
| 5,433,589 | 7/1995 | Wada et al. | 418/55.5 |

*Primary Examiner*—John J. Vrablik

*Attorney, Agent, or Firm*—Baker & Botts, LLP

[57] ABSTRACT

A scroll type fluid displacement apparatus having a rotation regulating mechanism. The rotation regulating mechanism comprises a crank pin which inserts into an eccentric hole of a bushing. The crank pin has at least one portion which regulates rotation of the crank pin within the eccentric hole thereby regulating an angle of swing of the bushing around a center of the crank pin.

5 Claims, 8 Drawing Sheets

SCROLL TYPE FLUID DISPLACEMENT APPARATUS HAVING A CONTROL SYSTEM OF LINE CONTACTS BETWEEN SPIRAL ELEMENTS

This application is a divisional of application Ser. No. 08/530,890, filed Sep. 20, 1995, abandoned.

BACKGROUND OF THE INVENTION

1. Field of the Invention

The invention relates to a fluid displacement apparatus, and more particularly, to a scroll type refrigerant compressor.

2. Description of the Prior Art

Scroll type refrigerant compressors are well known. For example, U.S. Pat. No. 4,824,346 discloses a device including two scroll members each having an end plate and a spiroidal or involute spiral element. The scroll members are maintained angularly offset so that the spiral elements interfit and form a plurality of line contacts between their spiral curved surfaces to thereby seal off and define at least one pair of fluid pockets. The relative orbital motion between these scroll members shifts the line contacts along the spiral curved surface, and therefore, changes the volume of the fluid pockets. The volume of the fluid pockets increases or decreases depending on the direction of orbital motion. Therefore, the scroll type compressor is able to compress, expand or pump fluids. In comparison with conventional piston-type compressors, a scroll type compressor has certain advantages such as fewer parts, and continuous compression of fluid. There are also, however, several unresolved problems, for example, sealing of the fluid pockets, and wearing of the spiral elements and outlet and inlet portions.

One of these unresolved problems involves maintaining a suitable sealing force along the line contacts between the spiral elements. In particular, it is desired that a sealing force be sufficiently maintained along the line contacts in a scroll-type compressor. The fluid pockets are defined by the line contacts between the two spiral elements which are interfitted together. The line contacts shift along the surface of the spiral elements toward the center of the spiral elements due to the orbital motion of the scroll members and thereby move the fluid pockets to the center of the spiral elements with consequent reduction of volume and compression of the fluid in the pockets. If a sufficient sealing force is not maintained along the line contacts, the fluid pockets cannot be compressed. On the other hand, if the sealing force between the spiral elements is too large, wear of the surfaces of the spiral elements increases. Therefore, the sealing force between the spiral elements must be suitably maintained. However, it may be difficult to maintain a suitable sealing force because of dimensional errors in manufacturing of the spiral elements. Further, decreasing the dimensional errors of the spiral elements would complicate their manufacture.

One attempt at solving this problem is disclosed in U.S. Pat. No. 4,580,956 to Takahashi et al. Referring to FIGS. 1, 2 and 3, a mechanism for restricting the angle through which bushing 27 pivots or swings around crank pin 142 is connected between disk-shaped rotor 141 and bushing 27. The restriction mechanism comprises an axial projection, such as pin 33, projecting from axial end surface of bushing 27 a reception opening 34 formed on the axial end surface of disk-shaped rotor 141, and spring 32. Pin 33 is smaller than opening 34 so that a gap is left around pin 33. Spring 32 is placed in the gap between pin 33 and inner wall opening 34. Spring 32 pushes bushing 27, by way of pin 33, in the direction to separate the line contacts between spiral elements 202 and 212, i.e., to reduce the orbital radius of orbiting scroll 21. The separation is maintained by spring 32 until the rotation of drive shaft 14 reaches an established rotation frequency, i.e., the frequency at which the compressor is designed to operate. Spring 32 thus functions to keep spiral elements 202 and 212 out of radial contact until the rotation of the orbiting parts generates a centrifugal force of sufficient magnitude to overcome the urging force of radial spring 32 and radial sealing occurs between the spiral elements.

Bushing 27 is normally produced by forging, but pin 33 cannot be forged. Therefore, this arrangement, requires increased processing time. Further, the cost of producing bushing 27 and disk shaped rotor 141 is increased because pin 33 must be finished by cutting particularly, eccentric cutting and disk-shaped rotor 141 requires many parts, such as spring 32.

SUMMARY OF THE INVENTION

It is an object of the invention to provide a scroll type compressor which has excellent sealing of the fluid pockets and reduced wearing of the spiral elements.

It is another object of the present invention to provide a scroll compressor which is simple in construction and production.

According to the present invention, a fluid displacement apparatus includes a housing having a fluid inlet port, a fluid outlet port and a sleeve. A fixed scroll is fixedly disposed within the housing and has a first end plate from which a first wrap extends. An orbiting scroll is movably disposed within the housing and has a second end plate from which a second wrap extends. A boss extends from an opposite surface of the second end plate from which the second wrap extends. The first and second wraps interfit at an angular offset to make a plurality of line contacts to define at least one sealed off fluid pocket. A drive shaft is supported for rotary motion by the sleeve of the housing and has a disk at its inner end. A bushing has a connection portion with a generally cylindrical circumferential surface rotatably supported in the boss by a bearing, and a balance weight extending radially from the connection portion about a portion of the circumferential surface. The bushing has a hole spaced eccentrically from a center of the bushing. The center of the bushing is spaced from a center of the drive shaft a distance equal to a radius of orbiting motion of the orbiting scroll. A crank pin extends from the disk toward the bushing at a location spaced from an axis of rotation of the drive shaft. The crank pin is fixedly inserted into the eccentric hole in the bushing. A regulating mechanism is disposed between the crank pin and the eccentric hole for regulating an angle by which the bushing may swing around a center of the crank pin.

Further objects, features and advantages of this invention will be understood from the following detailed description of the preferred embodiments of this invention with reference to the annexed drawings.

DETAILED DESCRIPTION OF THE DRAWINGS

Figure 5:
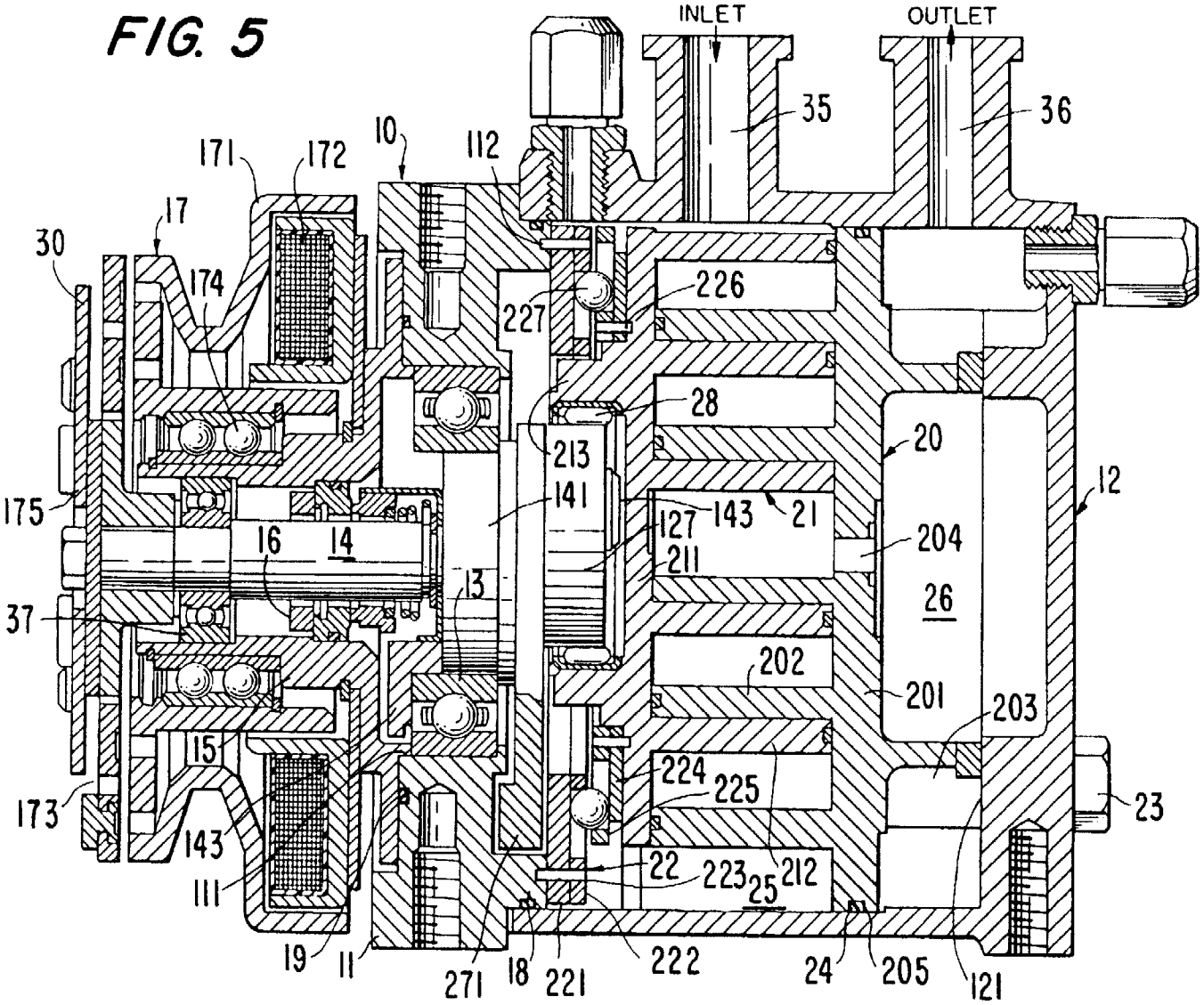
FIG. 5 is a cross sectional view of a compressor type fluid displacement apparatus according to one embodiment of the present invention.

Referring to FIG. 5, a fluid displacement apparatus in accordance with one embodiment of the present invention, in particular a scroll-type refrigerant compressor is shown. The compressor includes housing 10 comprising front end plate 11 and cup-shaped casing 12 fastened to an end surface of front end plate 11. Opening 111 is formed in the center of front end plate 11 for supporting drive shaft 14. The center of drive shaft 14 is thus aligned or concentric with the center line of housing 10. Annular projection 112, concentric with opening 11, is formed on the rear end surface of front end plate 11 and faces cup-shaped casing 12. Annular projection 112 contacts an inner wall of the opening of cup shaped casing 12. Cup-shaped casing 12 is attached to the rear end surface in front end plate 11 by a fastening device, such as bolts and nuts (not shown), so that the opening of cup-shaped casing 12 is covered by front end plate 11. O-ring 18 is placed between the outer peripheral surface of annular projection 112 and the inner wall of the opening of cup-shaped casing 12 to seal the mating surfaces between front end plate 11 and cup-shaped casing 12.

Drive shaft 14 is formed with disk shaped rotor 141 at its inner end portion. Disk shaped rotor 141 is rotatably supported by front end plate 11 through bearing 13 located within opening 111. Front end plate 11 has annular sleeve 15 projecting from its front end surface. Sleeve 15 surrounds drive shaft 14 to define a shaft seal cavity. Shaft seal assembly 16 is assembled on drive shaft 14 within the shaft seal cavity. O-ring 19 is placed between the front end surface of front end plate 11 and sleeve 15 to seal the mating surfaces between front end plate 11 and sleeve 15. As shown in FIG. 5, sleeve 15 is formed separately from front end plate 11 and is attached to the front end surface of front end plate 11 by screws (not shown). Alternatively, sleeve 15 may be formed integral with front end plate 11.

Electromagnetic clutch 17 is supported on the outer surface of sleeve 15 and is connected to the outer end portion of drive shaft 14. Electromagnetic clutch 17 comprises a pulley 171 rotatably supported by sleeve 15 through bearing 174 carried on the outer surface of sleeve 15, magnetic coil 172 which extends into an annular cavity of pulley 171 and is fixed on sleeve 15 by a support plate, and armature plate 173 fixed on the outer end portion of drive shaft 14 which extends from sleeve 15. Drive shaft 14 is thus driven by an external power source, such as the engine of a vehicle, through a rotation transmitting device, such as the above described electromagnetic clutch 17.

A number of elements are located within the inner chamber of cup shaped casing 12 including fixed scroll 20, orbiting scroll 21, a driving mechanism for orbiting scroll 21, and rotation preventing/thrust bearing device 22 for orbiting scroll 21. The inner chamber of cup-shaped casing 12 is formed between the inner wall of cup-shaped casing 12 and the rear end surface of front end plate 11.

Fixed scroll 20 includes circular end plate 201, wrap or spiral element (spiroidal wall) 202 affixed to or extending from one end surface of circular end plate 201, and a plurality of internal bosses 203. The end surface of each boss 203 is seated on an inner end surface of end plate portion 121 of cup-shaped casing 12 and is fixed on end plate portion 121 by a plurality of bolts 23, one of which is shown in FIG. 5. Circular end plate 201 of fixed scroll 20 partitions the inner chamber of cup-shaped casing 12 into discharge chamber 26 having bosses 203, and suction chamber 25, in which spiral element 202 of fixed scroll 20 is located. Sealing member 24 is placed within circumferential groove 205 in circular end plate 201 to form a seal between the inner wall of cupped-shaped casing 12 and outer peripheral surface of circular end plate 201. Hole or discharge port 204 is formed through circular end plate 201, at a position near the center of the spiral elements, to provide communication between discharge chamber 26 and suction chamber 25.

Orbiting scroll 21, which is disposed in suction chamber 25, includes circular end plate 211 and wrap or spiral element 212 affixed to or extending from one end surface of circular end plate 211. Both spiral elements 202 and 212 interfit at an angular offset of 180° and a predetermined radial offset to make a plurality of line contacts. The spiral elements define at least one pair of fluid pockets between their interfitting surfaces. Orbiting scroll 21 is connected to the driving mechanism and rotation preventing/thrust bearing device 22 to effect orbital motion of orbiting scroll 21 at circular radius Ro by the rotation of drive shaft 14 and thereby compresses fluid passing through the compressor.

Generally, radius Ro of orbital motion is given by:

$$\{(\text{the pitch of the spiral elements})-2\ (\text{the wall thickness of the spiral elements})\}/2$$

Figure 1:
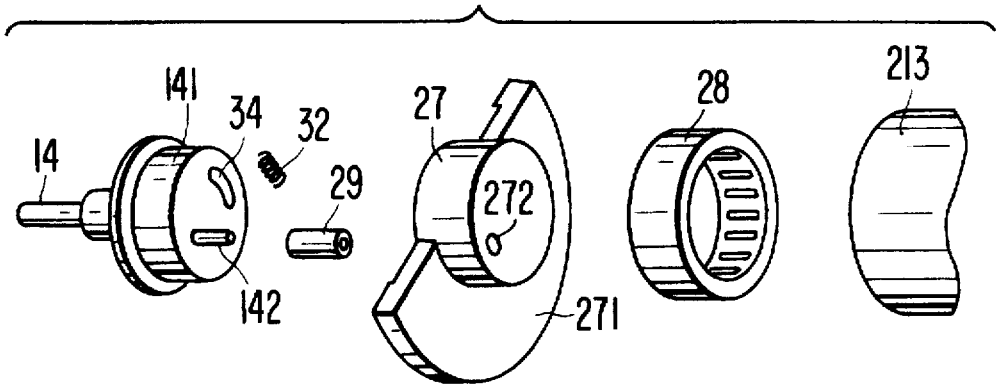
FIG. 1 (PRIOR ART)
FIG. 1 is an exploded perspective view of a driving mechanism of a conventional scroll compressor.
Figure 2:
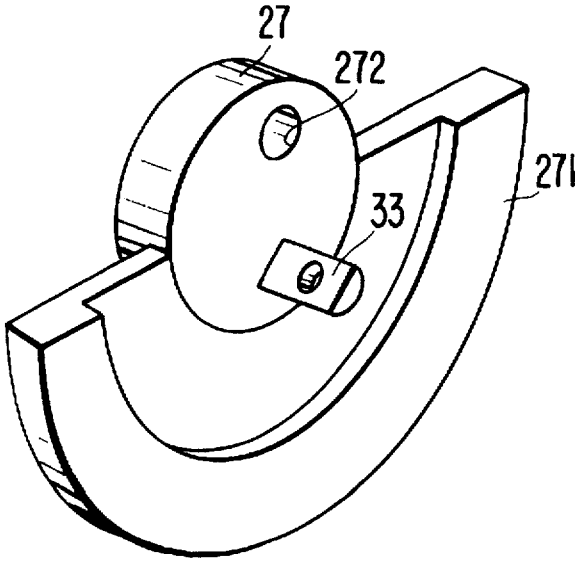
FIG. 2 (PRIOR ART)
FIG. 2 is a perspective view of the bushing from the opposite side of FIG. 1.
Figure 3:
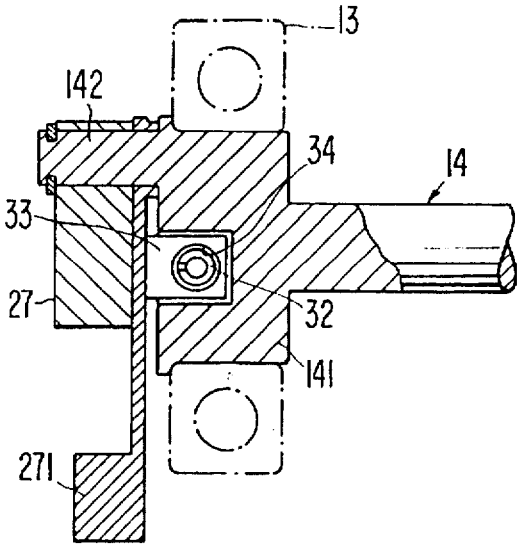
FIG. 3 (PRIOR ART)
FIG. 3 is a sectional view of the conventional driving mechanism illustrating the relationship between the crank pin and the bushing.
Figure 4:
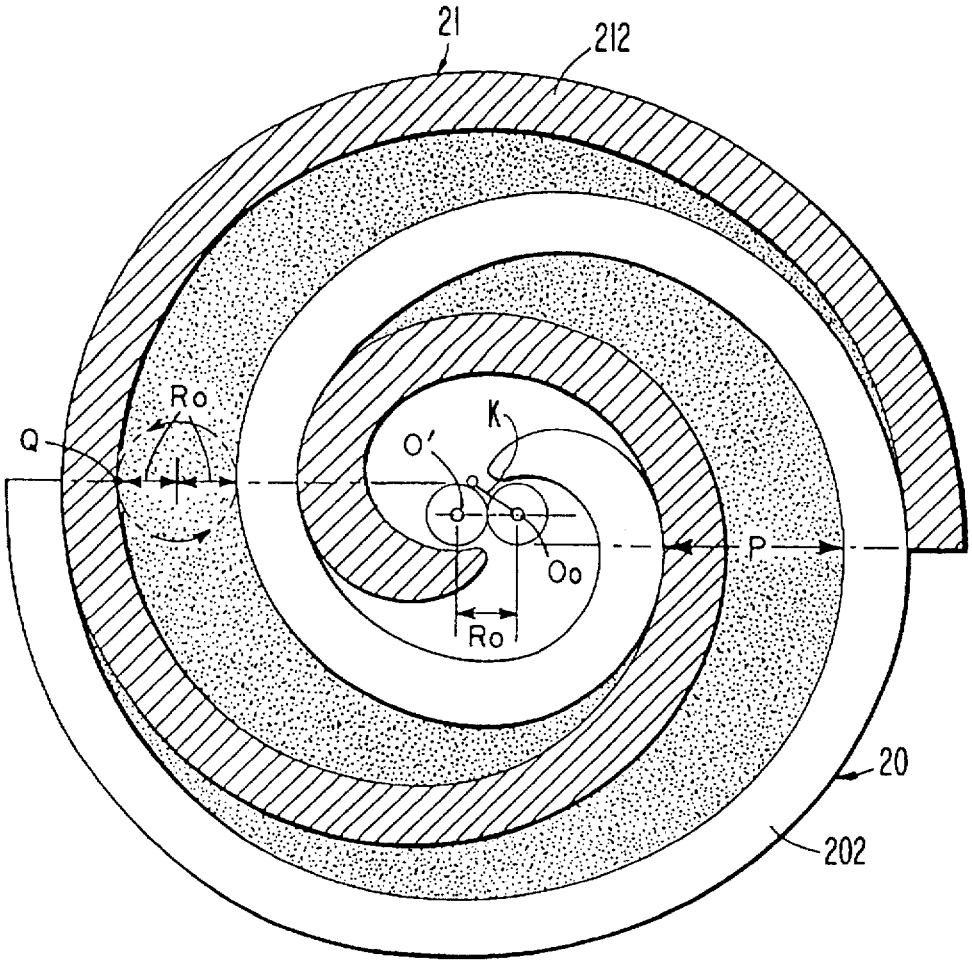
FIG. 4 is a sectional view illustrating the spiral elements of the fixed and orbiting scrolls.

As seen in FIG. 4, the pitch P of the spiral element can be defined by $2\pi rg$, where rg is the involute generating circle radius. The radius Ro of orbital motion is also illustrated in FIG. 4, as a locus of an arbitrary point Q on orbiting scroll 21. The center O' of spiral element 212 is placed radially offset from the center Oo of spiral element 202 by distance Ro.

Figure 6:
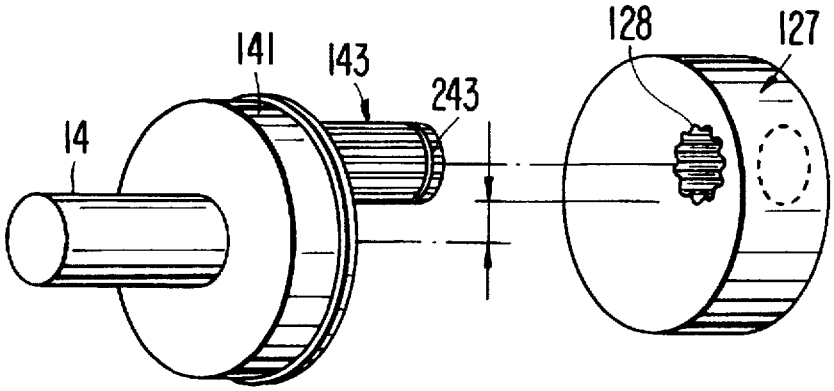
FIG. 6 is a perspective view of the driving mechanism illustrating the relationship between the crank pin and the bushing in accordance with one embodiment of the present invention.

Referring to FIG. 6, the driving mechanism of orbiting scroll 21 will be described in greater detail. Drive shaft 14 is provided with disk-shaped rotor 141 at its inner end portion, rotatably supported by front end plate 11 through bearing 13 located within opening 111 of front end plate 11. A crank pin or drive pin 143 projects axially from an axial end surface of disk-shaped rotor 141 and is radially offset from the center of drive shaft 14. Circular end plate 211 of orbiting scroll 21 has a tubular boss 213 axially projecting from the end surface opposite from which spiral element 212 extends. A discoid or short axial bushing 127 fits into boss 213, and is rotatably supported therein by a bearing, such as needle bearing 28. Bushing 127 has a balance weight 271 which is shaped as a portion of a disc or ring and extends radially from bushing 127 along a front end surface thereof. An eccentric hole 128 is formed in bushing 127 at a position radially offset from the center of bushing 127.

Crank pin 143 includes a plurality of rectangular-shaped grooves, such as splines, formed on a peripheral surface thereof extending in an axial direction and ring-shaped groove 243 formed circumferentially on the peripheral surface of crank pin 143. Further, hole 128 has a plurality of rectangular-shaped grooves, such as splines, corresponding to the splines of crank pin 143. Crank pin 143 fits into hole 128 of bushing 127 so that the splines of crank pin 143 and hole 12 engage. Crank pin 143 is secured within hole 128 by inserting a snap ring (not shown) into ring shaped groove 243. Further, crank pin 143 includes a plurality of base walls **143*a* formed on the bottom of the rectangular shaped grooves, a plurality of surface portions 143*b* formed on the surface of crank pin 143 and a plurality of side walls 143*c* formed on the side walls of the rectangular shaped grooves. Each side wall 143*c* is designed to be contained within a circle of radius R formed around center O of crank pin 143. Hole 128 of bushing 127 includes a plurality of base walls 128*a* formed on the bottom of the rectangular shaped grooves, a plurality of surface portions 128*b* and a plurality of side walls 128*c* formed on the side walls of the rectangular shaped grooves. Each side wall 128*c* is also designed to be contained within a circle of radius R formed around center O of crank pin 143. In general, crank pin 143 is produced, for example, by forging, rolling or cutting. Bushing 127** is produced, for example, by broaching, sinter forging or precision forging.

Figure 7:
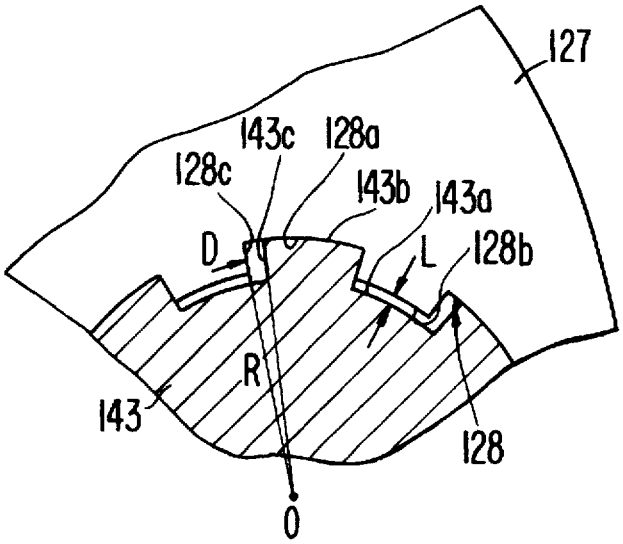
FIG. 7 is an enlarged cross sectional view of the crank pin inserted into the bushing shown in FIG. 6.

Crank pin 143 is designed so gaps are created between crank pin 143 and hole 128 of bushing 127 as shown in FIG. 7. That is, distance D is the distance between side wall **143*c* of crank pin 143 and side wall 128*c* of hole 128. Distance L, which is play in a radial direction of crank pin 143, is the distance between base wall 143*a* of crank pin 143 and surface portion 128*b* of hole 128. Distance D provides play in the rotation of crank pin 143** around it's longitudinal axis. Distance L is sufficiently small to be within the tolerance for a general use bearing mechanism.

When the compressor starts up drive shaft 14 rotates, thereby driving bushing 127 in an orbital path by way of crank pin 143. Bushing 127 can also rotate within needle bearing 28. Thereby, orbiting scroll 21 undergoes orbital motion of radius Ro due to the rotation of drive shaft 14. As orbiting scroll 21 orbits, line contacts between spiral elements 202 and 212 shift to the center of the spiral elements along the surfaces of the spiral elements. Fluid pockets defined between spiral elements 202 and 212 move to the center of the spiral elements with a consequent reduction of volume and compression of the fluid in the fluid pockets. Fluid or refrigerant gas, introduced into suction chamber 25 through fluid inlet port 35 on cup-shaped casing 12, is taken into the fluid pockets, and compressed. The compressed fluid is discharged into discharge chamber 26 from the fluid pockets at the spiral element's center through hole 204. The compressed fluid is thereafter discharged through fluid outlet port 36 on cup-shaped casing 12 to an external fluid circuit, for example, a cooling circuit.

In this arrangement, the rotational movement of bushing 127 is substantially limited by gap D. Distance D limits the amount by which bushing 127 swings around crank pin 143 to a selected degree. Thereby, when the compressor starts up, orbiting scroll 21 moves until the distance D is shifted from a side of a side wall **143*c* of crank pin 143 forward the direction of rotation to a side of a side wall 143*c* of crank pin 143 rearward the direction of rotation. This movement is shown by the locus K drawn by center Oo of orbiting scroll 21 as shown in FIG. 4. The distance D also allows a suitable contact force to be maintained between spiral elements 202 and 212 even if dimensional errors occur during manufacturing spiral elements 202 and 212. That is, if a contact force between spiral elements 202 and 212 becomes excessive, the force is transmitted through orbiting scroll 21 to bushing 127**. Thereafter, the excessive force is absorbed in the rotational play provided by gap D.

As a result, pin 33 of bushing 127, opening 34 and spring 32 for limiting an angle by which bushing 127 swings around crank pin 143 are no longer necessary. Bushing 127 can, therefore, be produced by a forging process. Further, the cavity between crank pin 143 and hole 128 of bushing 127 does not generate a sludge and seize up because lubricating oil is easily introduced into the cavity.

Figure 8:
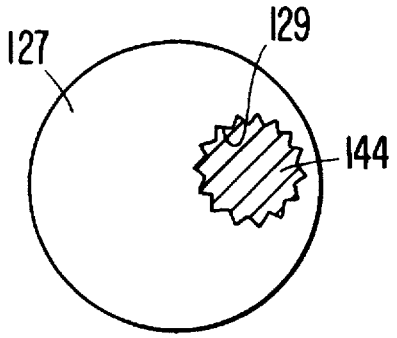
FIG. 8 is a cross sectional view of the crank pin inserted into the bushing in accordance with a second embodiment of the present invention.
Figure 9:
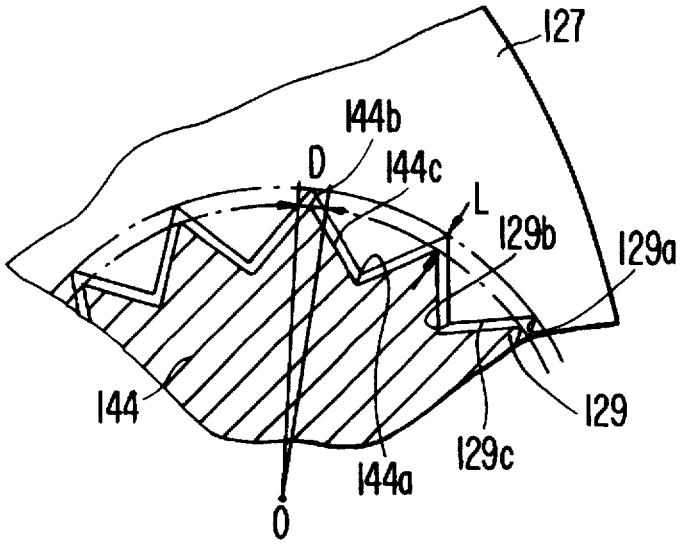
FIG. 9 is an enlarged cross sectional view of the crank pin inserted into the bushing shown in FIG. 8.

FIGS. 8 and 9 illustrate a second embodiment of the present. Crank pin 144 includes a plurality of saw teeth extending in an axial direction of crank pin 144 thereby forming a serration on the peripheral surface of crank pin 144. Further, bushing 127 includes hole 129 formed eccentric with the axial center of bushing 127 and having a plurality of saw teeth forming a serration, corresponding to the serration of crank pin 144. Crank pin 144 fits into the eccentrically disposed hole 129 of bushing 127 so that the serrations of crank pin 114 and hole 129 engage. Bushing 127 is, therefore, driven in an orbital path by crank pin 144 and can rotate within needle bearing 28. Crank pin 144 includes a plurality of bottom portions **144*a* formed on the teeth, a plurality of top portions 144*b* formed on the top of the teeth and a plurality of slope portions 144*c*, each joining a bottom portion 144*a* with a top portion 144*b* in radial cross section. Each of top portions 144*b* and bottom portions 144*a* are contained within a circle centered around center O of crank pin 144. Hole 129 of bushing 127 includes a plurality of bottom portions 129*a* formed on the bottom of the teeth, a plurality of top portions 129*b* formed on the top of the teeth and a plurality of slope portion 129*c*, each slope portion joining a bottom portion 129*a* with a top portion 129*b* in radial cross section. Each of top portions 129*b* and bottom portions 129*a* are respectively contained within a circle centered around center O of hole 129. That is, hole 129 is formed with a radial cross section analogous to the radial cross section of crank pin 144**.

Furthermore, crank pin 144 is designed to create gaps between crank pin 144 and hole 129 of bushing 127 as shown in FIG. 9. Distance D is defined by the distance which top portion **144*b* of crank pin 144 traverses during swinging between adjacent slope portions 129*c* of hole 129. Distance L, which is play in a radial direction of crank pin 144, is defined by the distance between top portion 144*b* of crank pin 144 and bottom portion 129*a* of hole 129. Distance D provides a constant play in the rotation crank pin 144** around its longitudinal axis. Further, distance L is sufficiently small to be within the tolerance for a general use bearing.

In this arrangement, the distance by which bushing 127 swings around crank pin 144 is limited by the distance D.

Thereby, when the compressor starts up, orbiting scroll 21 moves so that its center Oo draws an arc shape locus K limited by the distance D, as shown in FIG. 4.

Figure 10:
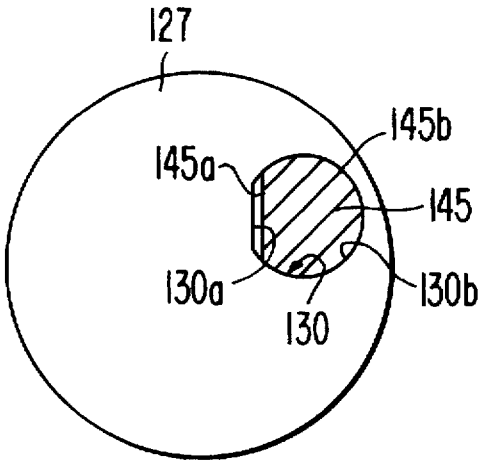
FIG. 10 is a cross sectional view of the crank pin inserted into the bushing in accordance with a third embodiment of the present invention.
Figure 11:
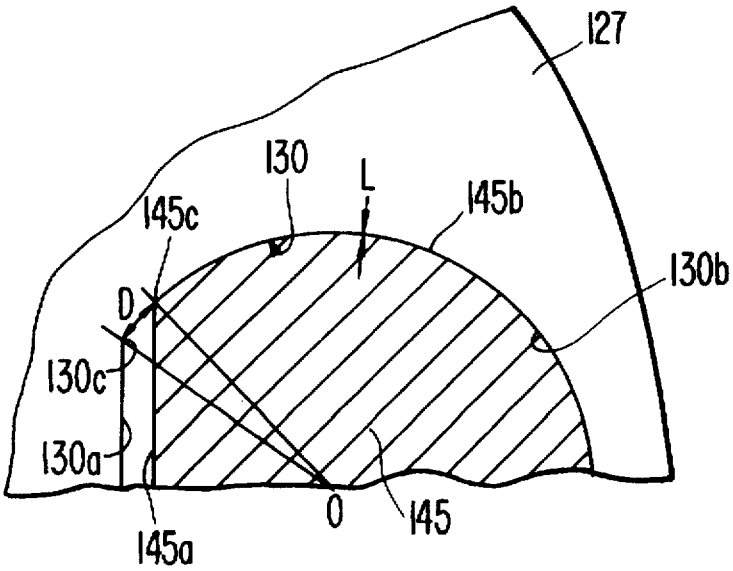
FIG. 11 is an enlarged cross sectional view of the crank pin inserted into the bushing shown in FIG. 10.

FIGS. 10 and 11 illustrate a third embodiment of the present invention. Crank pin 145 is formed having a D shaped cross section. Crank pin 145 includes flat surface 145*a*, curved surface 145*b* formed thereon and edge portion 145*c* joining flat surface 145*a* with curved surface 145*b*, extending along the axial direction of crank pin 145. Further, bushing 127 has a D shaped hole 130 formed eccentric to the radial center of bushing 127. Hole 130 of bushing 127 includes flat surface 130*a* curved surface 130*b* and corner portion 130*c* joining flat surface 130*a* with curved surface 130*b*.

Crank pin 145 is designed to create gaps between crank pin 145 and hole 130 of bushing 127 as shown in FIG. 11. Distance D is defined by the distance which edge portion 145*c* of crank pin 145 during rotating to corner portion 130*c* of hole 130. Distance L, which is play in a radial direction of crank pin 145, is defined by the distance between curved surface 145*b* of crank pin 145 and curved surface 130*b* of hole 130. Distance D provides a constant play in the rotation of crank pin 145 around its longitudinal axis. Distance L is sufficiently small to be within the tolerance for a general use bearing.

Figure 12:
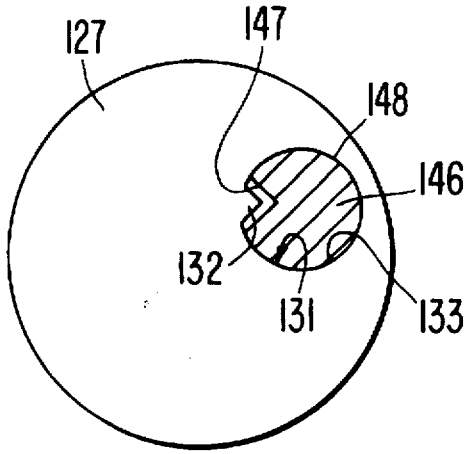
FIG. 12 is a cross sectional view of the crank pin inserted into the bushing in accordance with a fourth embodiment of the present invention.
Figure 13:
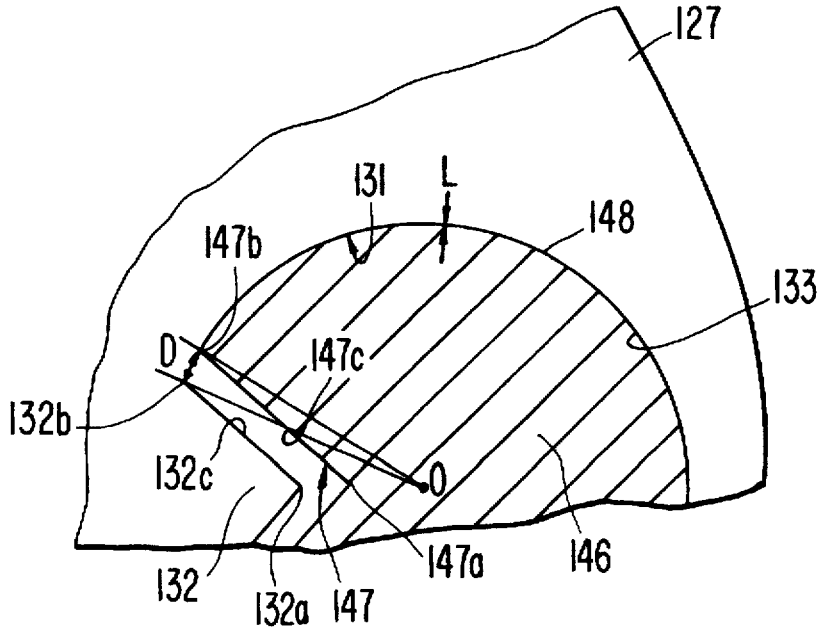
FIG. 13 is an enlarged cross sectional view of the crank pin inserted into the bushing shown in FIG. 12.

FIGS. 12 and 13 illustrate a fourth embodiment of the present invention. FIG. 12 shows a cross section of crank pin 146 and hole 131. Crank pin 146 include V shaped groove 147 and curved surface 148 extending along the axial direction of crank pin 146. V shaped groove 147 includes bottom portion 147*a*, slope portion 147*c* and edge portion 147*b* joining slope portion 147*c* with curved surface 148. Further, bushing 127 includes hole 131 formed eccentric to the radial center of bushing 127. The cross section of hole 131 of bushing 127 includes V-shaped projection 132, corresponding to V shaped groove 147 of crank pin 146 and curved surface 133. V shaped projection 132 includes top portion 132*a*, corner portion 132*b* and slope portion 132*c* joining top portion 132*a* with corner portion 132*b*. Crank pin 146 is designed to create gaps between crank pin 146 and hole 131 of bushing 127 as shown in FIG. 13. Distance D is defined by the distance which edge portion 147*b* of crank pin 146 traverses when rotating to corner portion 132*c*. Distance L, which is play in a radial direction of crank pin 146, is defined by the distance between curved surface 148 of crank pin 146 and curved surface 133 of hole 131. Distance D provides a constant play in the rotation of crank pin 146 around its longitudinal axis. Further, distance L is sufficiently small to be within the tolerance for a general use bearing.

Figure 14:
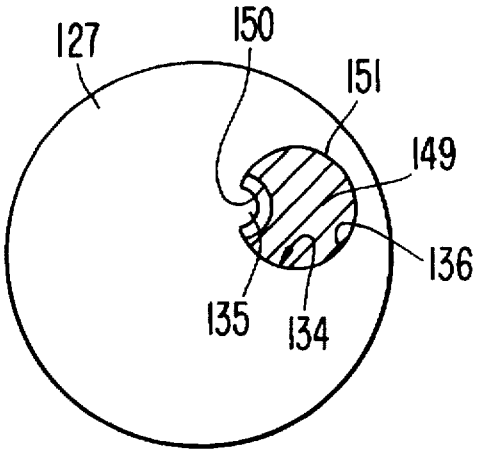
FIG. 14 is a cross sectional view of the crank pin inserted into the bushing in accordance with a fifth embodiment of the present invention.
Figure 15:
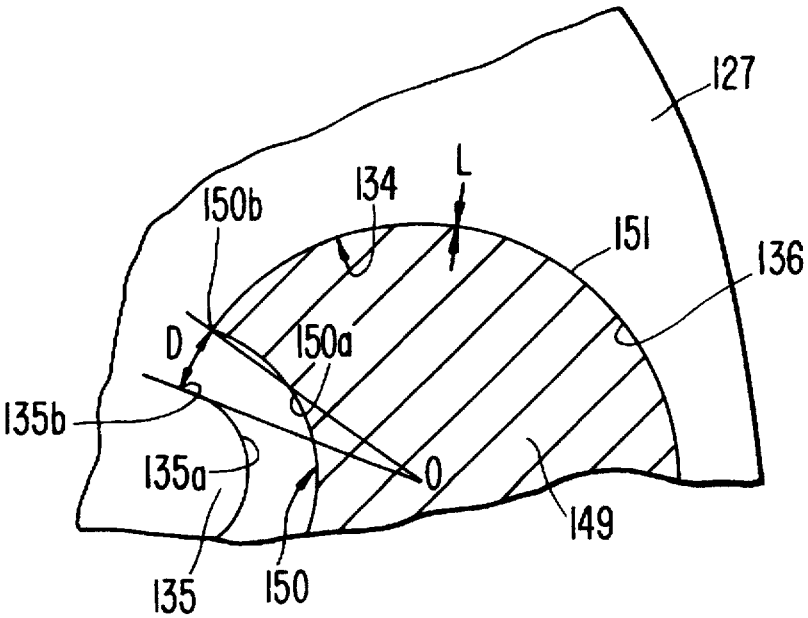
FIG. 15 is an enlarged cross sectional view of the crank pin inserted into the bushing shown in FIG. 14.

FIGS. 14 and 15 illustrate a fifth embodiment of the present invention. FIG. 14 shows a cross section of crank pin 149 and hole 136. Crank pin 149 includes circular-shaped groove 150 and curved surface 151 extending along the axial direction of crank pin 149. Circular shaped groove 150 includes circle portion 150*a*, having a radius of curvature, and edge portion 150*b* joining circle portion 150*a* with curved surface 151.

Further, bushing 127 includes hole 136 formed eccentric to the radial center of bushing 127 and having a cross section including circular-shaped projection 135 corresponding to circular-shaped groove 150 of crank pin 149 and curved surface 136. Circular-shaped projection 135 includes circle portion 135*a* having a radius of curvature and edge portion 135*b* joining circle portion 135*a* with curved surface 136.

Crank pin 149 is designed to create gaps between crank pin 149 and hole 134 of bushing 127 as shown in FIG. 15. Distance D is defined by the distance which edge portion 150*b* traverses when rotating to bottom portion 135*b* of circular projection 135. Distance L, which is play in a radial direction of crank pin 149, is defined by the distance between curved surface 151 of crank pin 149 and curved surface 136 of hole 134. Distance D provides play in the rotation of crank pin 149 around its longitudinal axis. Distance L is sufficiently small to be within the tolerance for a general use bearing.

The second through fifth embodiments, shown in FIGS. 8–15 have substantially the same effects and advantages as those of the first embodiment shown in FIGS. 6 and 7.

Although the present invention has been described in connection with the preferred embodiment, the invention is not limited thereto. It will be easily understood by those of ordinary skill in the art that variations and modifications can be easily made within the scope of this invention as defined by the appended claims.

We claim:

1. A fluid displacement apparatus comprising:

a housing having a fluid inlet port, a fluid outlet port and a sleeve;

a fixed scroll fixedly disposed within said housing and having a first end plate;

a first wrap extending from said first end plate;

an orbiting scroll movably disposed within said housing and having a second end plate;

a second wrap extending from a surface of said second end plate, said first and second wraps interfitting at an angular offset to make a plurality of line contacts and thereby define at least one sealed off fluid pocket;

a boss extending from a surface of said second end plate opposite the surface from which the second wrap extends;

a drive shaft rotatably supported by said sleeve of said housing, said drive shaft having a disk at its inner end, a bushing having a generally cylindrical circumferential surface rotatably supported in said boss by a bearing, said bushing having a hole spaced eccentrically from a center of said bushing, said center of said bushing spaced from a center of said drive shaft a distance equal to a radius of orbiting motion of said orbiting scroll;

a balance weight extending radially from said connection portion about a portion of said circumferential surface;

a crank pin extending from said disk toward said bushing at a location spaced from an axis of rotation of said drive shaft, said crank pin inserted into said eccentric hole in said bushing; and, regulating means disposed between said crank pin and said eccentric hole for regulating an angle by which said bushing swings around a radial center of said crank pin, said regulating means comprising:

at least one arc shaped projection extending from an inner wall of said eccentric hole; and, at least one arc shaped groove formed on a peripheral surface of said crank pin.

2. A fluid displacement apparatus comprising:

a housing having a fluid inlet port, a fluid outlet port and a sleeve;

a fixed scroll fixedly disposed within said housing and having a first end plate;

a first wrap extending from said first end plate;

an orbiting scroll movably disposed within said housing and having a second end plate;

a second wrap extending from a surface of said second end plate, said first and second wraps interfitting at an angular offset to make a plurality of line contacts and thereby define at least one sealed off fluid pocket;

a boss extending from a surface of said second end plate opposite the surface from which the second wrap extends;

a drive shaft rotatably supported by said sleeve of said housing, said drive shaft having a disk at its inner end, a bushing having a generally cylindrical circumferential surface rotatably supported in said boss by a bearing, said bushing having a hole spaced eccentrically from a center of said bushing, said eccentric hole having at least one arc shaped projection extending from an inner wall thereof, said center of said bushing spaced from a center of said drive shaft a distance equal to a radius of orbiting motion of said orbiting scroll;

a balance weight extending radially from said connection portion about a portion of said circumferential surface;

a crank pin extending from said disk toward said bushing at a location spaced from an axis of rotation of said drive shaft, said crank pin inserted into said eccentric hole in said bushing, said crank pin having at least one arc shaped groove formed on a peripheral surface thereof; and, regulating means disposed between said crank pin and said eccentric hole for regulating an angle by which said bushing swings around a radial center of said crank pin;

wherein said regulating means comprises:

said arc shaped groove formed on a peripheral surface of said crank pin engaging with said arc shaped projection extending from an inner wall of said eccentric hole; and, a radial gap between said crank pin and said eccentric hole.

3. The fluid displacement apparatus recited in claim 2, wherein said radial gap is defined by a distance through which said crank pin draws a locus during orbital motion of said orbital scroll.

4. A fluid displacement apparatus comprising:

a housing having a fluid inlet port, a fluid outlet port and a sleeve;

a fixed scroll fixedly disposed within said housing and having a first end plate;

a first wrap extending from said first end plate;

an orbiting scroll movably disposed within said housing and having a second end plate;

a second wrap extending from a surface of said second end plate, said first and second wraps interfitting at an angular offset to make a plurality of line contacts and thereby define at least one sealed off fluid pocket;

a boss extending from a surface of said second end plate opposite the surface from which the second wrap extends;

a drive shaft rotatably supported by said sleeve of said housing, said drive shaft having a disk at its inner end, a bushing having a generally cylindrical circumferential surface rotatably supported in said boss by a bearing, said bushing having a hole spaced eccentrically from a center of said bushing, said center of said bushing spaced from a center of said drive shaft a distance equal to a radius of orbiting motion of said orbiting scroll;

a balance weight extending radially from said connection portion about a portion of said circumferential surface;

a crank pin extending from said disk toward said bushing at a location spaced from an axis of rotation of said drive shaft, said crank pin inserted into said eccentric hole in said bushing; and, regulating means disposed between said crank pin and said eccentric hole for regulating an angle by which said bushing swings around a radial center of said crank pin, said regulating means comprising:

said crank pin and said eccentric hole having analogous radial cross sections, said analogous radial cross sections including at least one portion operative to limit the angle by which the bushing rotates around said crank pin, said at least one portion of said analogous radial cross sections comprising an arc shaped groove engaging with an arc shaped projection; and, a radial gap between said crank pin and said hole, said radial gap comprising an arc shaped cross section defined by said arc shaped groove and said arc shaped projection.

5. The fluid displacement apparatus recited in claim 4, wherein said radial gap is defined by a distance through which said crank pin draws a locus during orbital motion of said orbital scroll.

* * * * *